United States Patent [19]

von Recklinghausen

[11] 4,037,061

[45] July 19, 1977

[54] PLANAR PATTERN VOICE COIL AUDIO TRANSDUCER

[75] Inventor: Daniel R. von Recklinghausen, Arlington, Mass.

[73] Assignee: Electro Audio Dynamics, Inc., Great Neck, N.Y.

[21] Appl. No.: 631,484

[22] Filed: Nov. 13, 1975

[51] Int. Cl.[2] ..... H04R 9/00

[52] U.S. Cl. ..... 179/115.5 PV

[58] Field of Search ..... 179/115.5 PV

[56] References Cited

U.S. PATENT DOCUMENTS

| | | | |
|---|---|---|---|
| 3,066,200 | 11/1962 | Pavlak | 179/115.5 PV |
| 3,141,071 | 7/1964 | Rich | 179/115.5 PV |
| 3,164,686 | 1/1965 | Tibbetts | 179/115.5 PV |
| 3,898,598 | 8/1975 | Asahi | 179/115.5 PV |
| 3,919,498 | 11/1975 | Beer | 179/115.5 PV |
| 3,922,504 | 11/1975 | Kishikawa et al. | 179/115.5 PV |

FOREIGN PATENT DOCUMENTS

| | | | |
|---|---|---|---|
| 239,344 | 8/1964 | Austria | 179/115.5 PV |

*Primary Examiner*—George G. Stellar

*Attorney, Agent, or Firm*—Holland, Armstrong, Wilkie & Previto

[57] ABSTRACT

An improved planar audio transducer or loudspeaker is described. It has a plastic diaphragm with a current carrying coil on one surface formed of aluminum conductors. A magnetic field is provided at the conductors from rows of magnets spaced from each other and mounted on opposite sides of the membrane on a pair of outer iron support members. A predetermined positioning of the magnets and a predetermined magnet and diaphragm spacing is provided by magnet mounting grooves in the iron support members and by surrounding the magnets with non-metallic frame members sandwiched between the iron magnet support members and the membrane.

2 Claims, 7 Drawing Figures

Fig. 1.
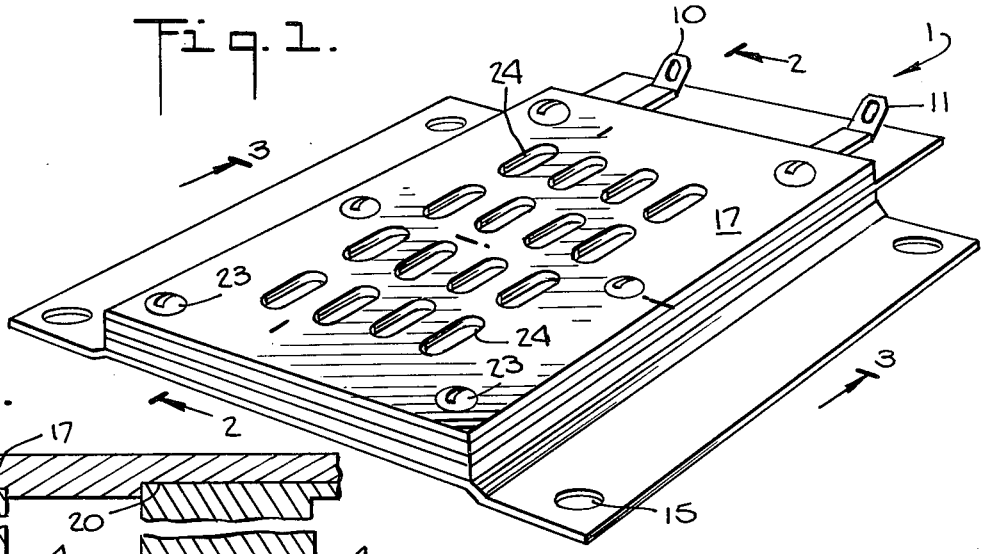
Fig 4.
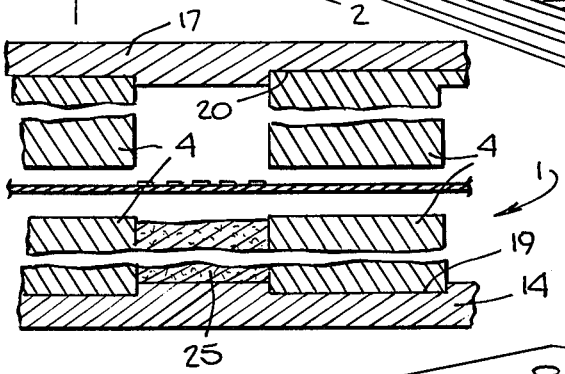
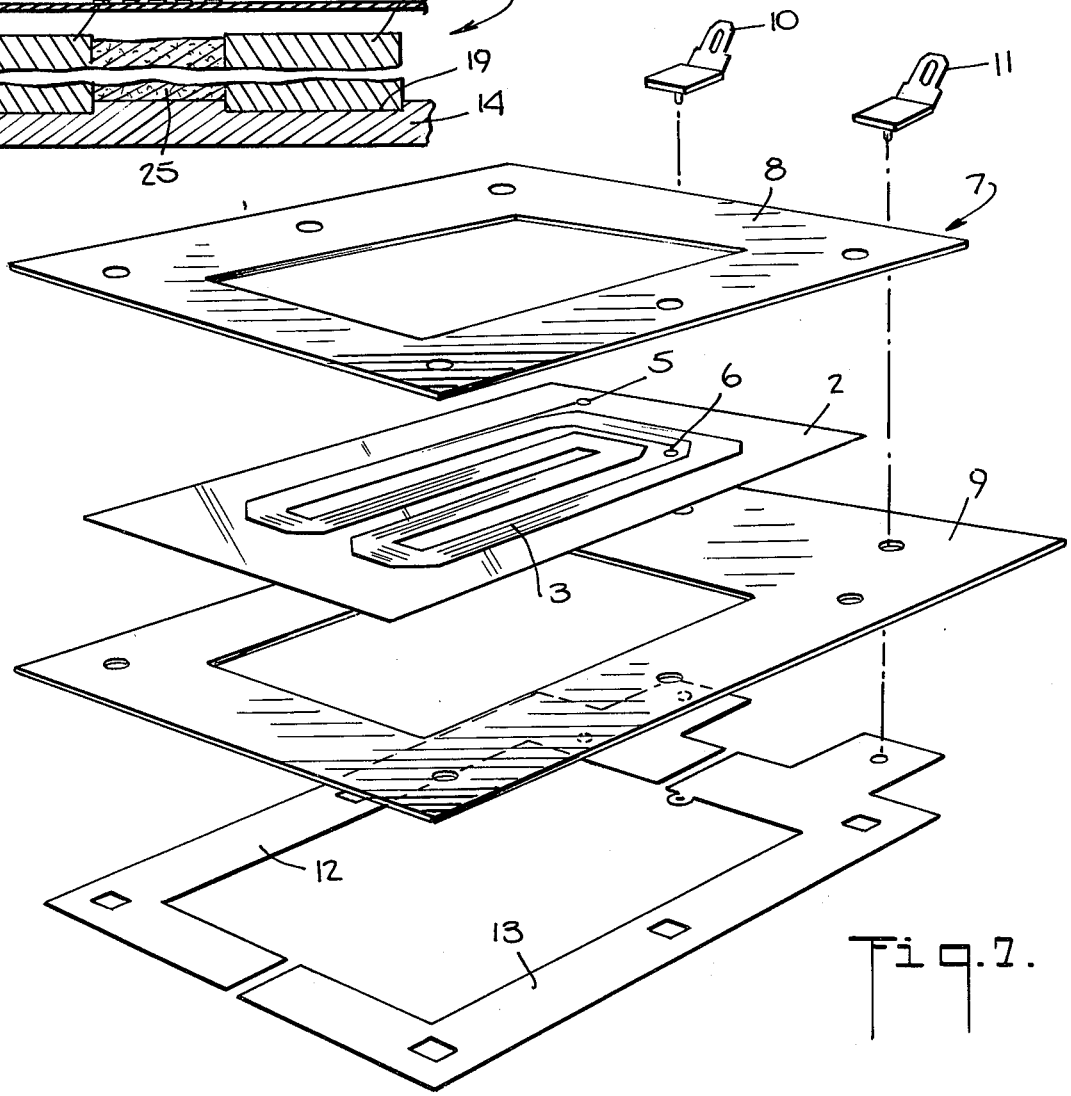
Fig. 7.

PLANAR PATTERN VOICE COIL AUDIO TRANSDUCER

BACKGROUND OF THE INVENTION

The present invention relates to electromagnetic audio transducers and particularly to an improved flat or planar transducer of relatively high efficiency and broad frequency response.

A variety of transducer or loudspeaker designs are used for providing sound systems having broad frequency responses and high output volumes. A number of the most popular transducers are relatively large and in particular have significant measurements in three dimensions. These speakers, for example, often utilize conical or other three dimensional vibrating members which occupy a significant volume and which require a correspondingly large mounting space.

It has been proposed to use transducers having a flat or planar form whereby a significant reduction can be made in the space required and so that the transducers are essentially a two dimensional device.

Difficulties have been encountered in prior planar transducers where one or all of the following deficiencies are present. One problem encountered with planar transducers is a limitation in their frequency range with reduced frequency responses being obtained at both the high and low ends. Certain planar speaker designs also have been found to be critical as regards the element spacing and the allowable spacing tolerances of the magnets and the diaphragms. The problem of controlling tolerances is present both during the transducer assembly and during transducer use and adjustment or repair. Additionally, deficiencies have been encountered in obtaining a sufficiently strong power output.

The improved planar transducer of the present invention has a design which permits a rapid and relatively simple assembly where the necessary element spacings and tolerances are automatically obtained as a result of the transducer design. Additionally, the planar transducer of the present invention provides a broad and uniform frequency response with an adequate power output.

These improvements are obtained by utilizing a preferred arrangement of magnet supporting iron backing members in combination with non-magnetic spacing and diaphragm framing members fitted together in a solid multilayer stack with the optimum magnet and membrane spacings resulting automatically from this arrangement of the elements.

Accordingly, an object of the present invention is to provide an improved planar audio transducer.

Another object of the present invention is to provide an improved planar transducer with a broad and uniform frequency response.

Another object of the present invention is to provide an improved planar acoustic transducer in which the necessary element spacings are easily obtained during assembly and are maintained thereafter during use and possible repair or adjustment.

Other and further objects of the invention will be obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawing forming a part of the specification, wherein:

FIG. 1 is a perspective view of a preferred embodiment of a planar acoustic transducer in accordance with the present invention.

FIG. 4 is an enlarged fragmentary vertical sectional view of a portion of the diaphragm and magnets.

FIG. 7 is an exploded perspective view of the membrane and the membrane mounting frame.

DESCRIPTION OF THE PREFERRED EMBODIMENT

Figure 6:
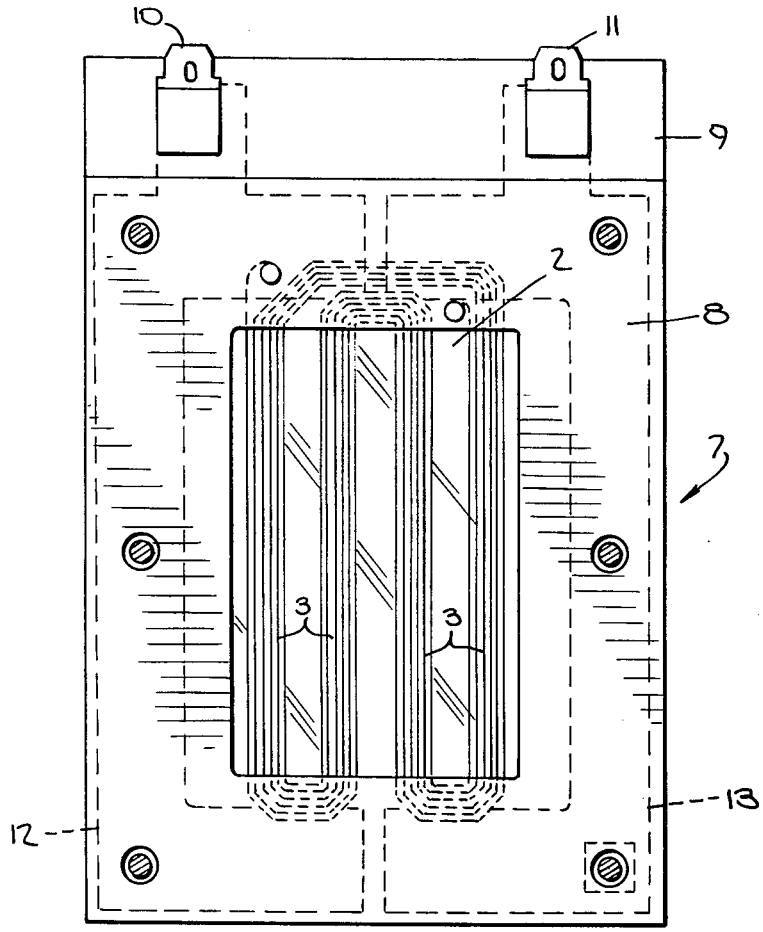
FIG. 6 is a top plan view of the mounted diaphragm.

The transducer 1 in accordance with the present invention comprises a moving flat plastic diaphragm 2 with etched aluminum conductors 3 operating in the fringing magnetic field of rod magnets 4 arranged as two groups in front of and behind the diaphragm 2.

FIG. 1 shows the assembled transducer 1 having a planar form with relatively large dimensions along its length and width and having a relatively minor height or thickness.

The diaphragm 2 is formed of flexible plastic material. A suitable plastic may be a polyimide, such as the E. I. duPont Kapton. Another suitable material is Mylar. The diaphragm 2 is cut to the desired shape from sheets which may have a thickness of about 1 mil with a probable range between about 0.5 mil and 1.5 mils depending upon the transducer size and the frequency response desired. The current conductors 3 are attached to the surface of the plastic diaphragm 2. The preferred coil form of the conductors 3 having the general shape illustrated in FIG. 6 and extending between terminals 5 and 6 is formed of aluminum strips. An aluminum sheet having a thickness of about 0.5 mils, for example, has been found satisfactory for forming the conductors 3. A printed sheet of aluminum is attached to the diaphragm 2 with a suitable adhesive such as an epoxy forming a tight bond between the aluminum sheet and the plastic diaphragm 2. Thereafter, the excess aluminum is etched away leaving an array of the conductors 3 of the desired form.

As illustrated in FIG. 6, the conductors 3 are arranged to provide a number of parallel aluminum strip conductors in spaced groups with the signal current flowing in the same direction in each group to provide the vibratory forces on the diaphragm 2.

The plastic diaphragm 2 is mounted in a support frame 7, as best illustrated in FIG. 7. The frame 7 comprises upper and lower non-metallic plastic frame members 8 and 9 which engage and grip the edges of the diaphragm 2. The thicknesses of the frame members 8 and 9 are set to provide the desired air gaps between the magnetic structure and the diaphragm 2. The terminals 5 and 6 for the signal input to the conductors 3 are fastened to the frame members 8 and 9 and the signal is carried to the conductors 3 from the transducer terminals 10 and 11 by suitable flat conductors 12 and 13 which may comprise etched or cut relatively thin copper or other conducting sheets. The relatively wide and uniformily thick conductors 12 and 13 form a portion of the gap determining structure when the transducer is assembled as described below.

The outer backing support members for the transducer 1 comprise a lower iron backing plate member 14 including suitable mounting apertures 19 and coupling apertures 16 and an upper iron backing member 17 with coupling apertures 18.

Figure 2:
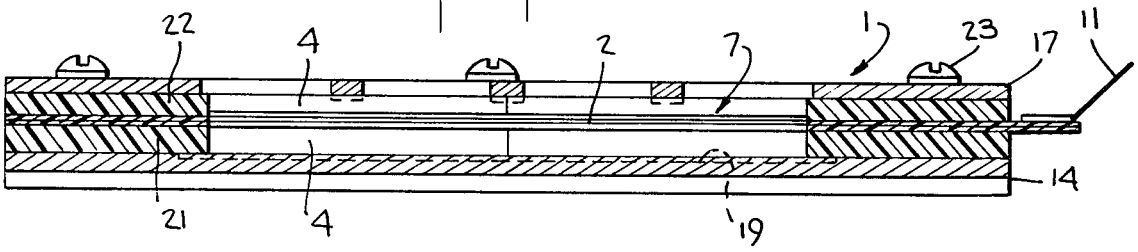
FIGS. 2 and 3 are vertical sectional views taken along line 2—2 and 3—3 on FIG. 1.

The magnetic structure for providing the magnetic field at the conductors 3 on the diaphragm 2 is composed of rows of magnets 4 held by their magnetic forces and located in slots 19 and 20 provided in the lower and upper backing members 14 and 17, respectively. The position of the outer surfaces of each of the magnets 4 with relation to the adjacent surfaces of the aluminum conductors 3 and the diaphragm 2 are determined by the thicknesses of the upper and lower spacing frames 21 and 22 positioned between the iron backing members 14 and 17 and the diaphragm mounting frame 7. The thicknesses of the frames 21 and 22 is preferably the same as the thickness of the magnets 4 permitting the several elements described above to be assembled into a tight sandwich-like or laminated structure using coupling screws 23, as shown in FIGS. 2 and 3.

Figure 5:
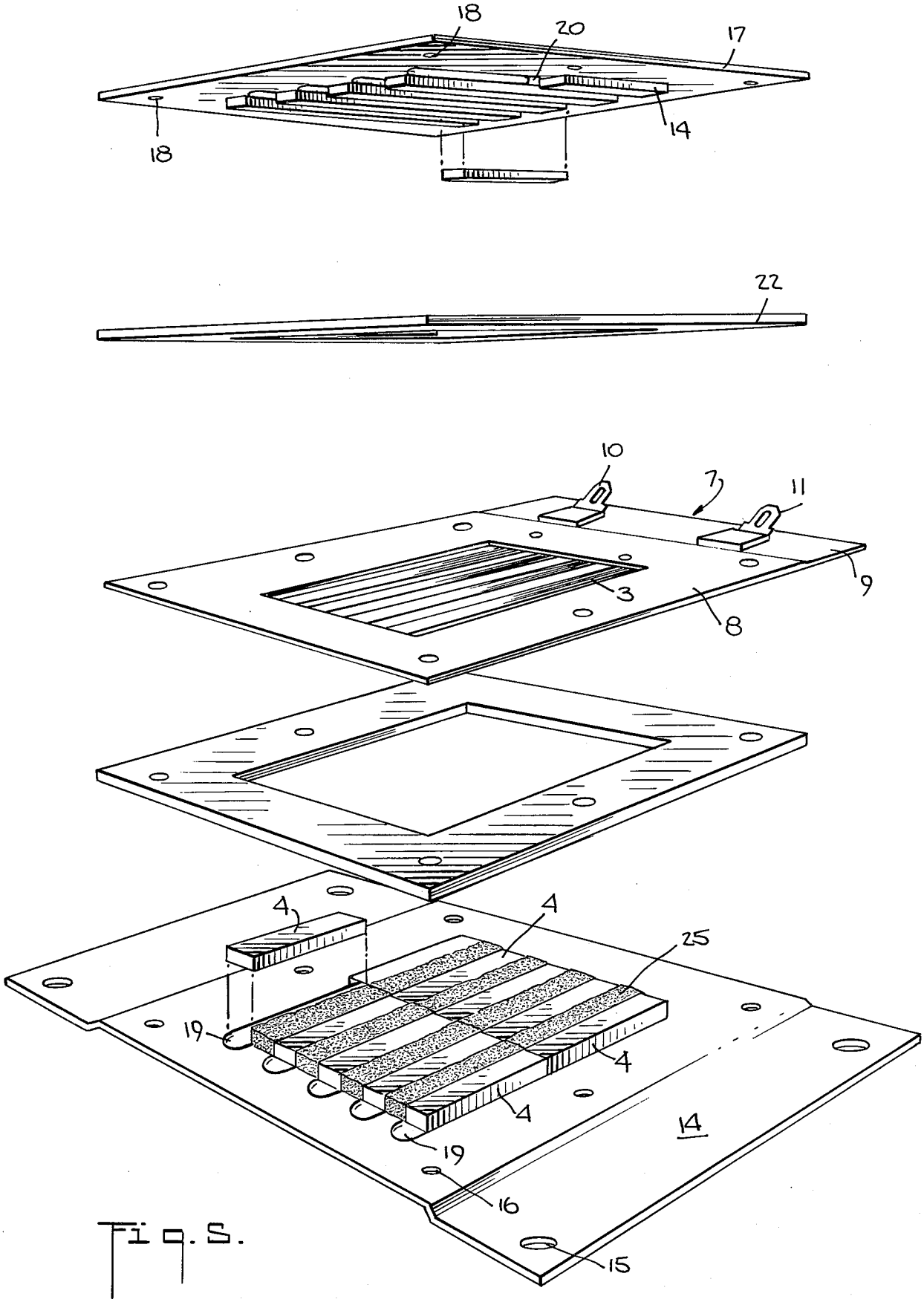
FIG. 5 is an exploded perspective view of the transducer of FIG. 1.

The rows of magnets 4 may be formed in two or more sections as illustrated in FIG. 5 with the positions of the sections being determined by the mounting slots 19 and 20 on the backing members 14 and 17 and with the relative spacing between the rows of magnets 4 and the diaphragm 2 being set by the thicknesses of the spacing frames 21 and 22 and the diaphragm 2 mounting frame 7.

Figure 3:
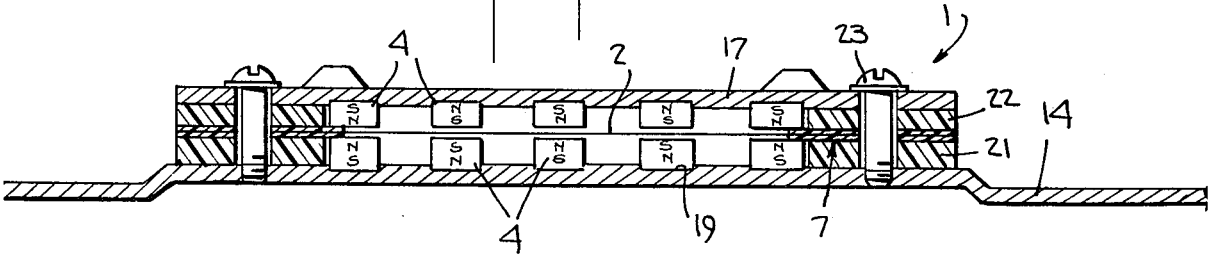

Magnets formed of ferro cobalt or samarium cobalt with their polarities arranged, as illustrated in FIG. 3, have been found to provide a fringing magnet field of about 3,500 gauss in the plane of the diaphragm 2 at the aluminum conductors 3. An improved frequency response at the high end has been found to be obtained by having a lesser spacing between the magnet 4 surfaces and the diaphragm 2 for the upper magnets 4 on backing member 17 than the lower magnets 4 on backing member 14 and by having the upper magnets thinner in cross-section, as illustrated in FIGS. 2 and 3. The spaced apertures 24 are preferably provided in the upper backing member 17 outwardly of the conductors 3 in the manner illustrated in FIG. 1. Damping material 25 such as felt is preferably positioned between the lower rows of magnets 4. The rear support member preferably is without apertures to provide for an improved low frequency response.

A planar transducer of the form described above may handle signal currents of several amperes and have a power output of up to about 30 Watts or more with a frequency response of from about 3 to 30 thousand Hertz.

It will be seen that an improved planar or flat transducer has been disclosed. The improved transducer has a mounting arrangement for its diaphragm and magnets whereby it is readily assembled with a preferred element spacing. This improved arrangement of elements permits an easy and a rapid manufacture of the transducer with the element spacing being well within the desired tolerances. The transducer's structure also provides for an assembly which maintains it as its maximum efficiency throughout its operating life. These improvements are incorporated in a transducer which has a broad and uniform frequency response and which is useful for relatively high volume outputs. The planar form of the transducer permits its use where a high fidelity audio signal is to be reproduced and where the reproducing transducer must occupy a relatively small space.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. An improved audio transducer comprising the combination of:

a flexible plastic diaphragm;

a planar electrical conductor positioned on a surface of said diaphragm having spaced parallel portions;

a magnetic array comprising a row of magnets positioned on and spaced from opposite surfaces of said diaphragm with the magnets of said rows being parallel to one another and to said diaphragm and to said conductor;

the polarity of adjacent magnets being arranged to form a fringing magnetic field at said parallel portions of said conductor;

plate-like iron backing members positioned on each side of said diaphragm and each having elongated slots for mounting and for positioning said rows of magnets;

rigid frame-like spacer means attached to the opposite edges of said diaphragm;

an additional rigid frame-like spacer member positioned between each of said backing members and said first named spacer means with each one having a thickness corresponding generally to the thickness of the adjacent rows of magnets for positively determining the relative positions of said magnets and said diaphragm;

said spacer means further comprising planar conductors coupled to said first named conductors on said diaphragm and positioned between said first named spacer means and one of said additional frame-like spacer members;

one of said iron backing members being imperforate and the other of said iron backing members including perforations for providing an improved high frequency response; and damping material positioned between the rows of magnets at the imperforate backing member.

2. The transducer as claimed in claim 1 in which the rows of magnets mounted on the perforated backing member are positioned closer to said diaphragm conductors than are the magnets on the imperforate backing member.

* * * * *